US006035461A

United States Patent [19]

Nguyen

[11] Patent Number: 6,035,461

[45] Date of Patent: Mar. 14, 2000

[54] BATHTUB SHOWER SPLASH GUARD

[76] Inventor: Cuong V. Nguyen, 14151 Dwyer Blvd., New Orleans, La. 70129

[21] Appl. No.: 09/177,747

[22] Filed: Oct. 23, 1998

[51] Int. Cl.[7] ..... A47K 3/22

[52] U.S. Cl. ..... 4/609; 52/34; 52/35; 52/716.2

[58] Field of Search ..... 4/609, 608, 607, 4/605, 558, 559; 52/287.1, 35, 34, 716.2

[56] References Cited

U.S. PATENT DOCUMENTS

| | | | |
|---|---|---|---|
| 3,855,642 | 12/1974 | Blitch | 4/149 |
| 3,952,337 | 4/1976 | Hansow | 4/148 |
| 4,189,790 | 2/1980 | Masters, III | 4/149 |
| 4,553,276 | 11/1985 | Paradis | 52/35 |
| 4,765,001 | 8/1988 | Smith | 4/609 |
| 4,944,050 | 7/1990 | Shames et al. | 4/609 |
| 5,241,714 | 9/1993 | Barry | 4/605 |
| 5,274,859 | 1/1994 | Redman et al. | 4/608 |

*Primary Examiner*—Henry J. Recla
*Assistant Examiner*—Tuan Nguyen
*Attorney, Agent, or Firm*—Henderson & Sturm

[57] ABSTRACT

A bathtub shower accessory comprising a number of shield units, each securable to the tub and shower stall sidewalls in a manner to prevent water from exiting the shower area past the end edges of the shower curtain. The shield units are stackable one on top of the other for the desired height attainment and can include tray compartments on the interior facing side for holding soap, shampoo, toothbrushes, etc., or a towel rack holder.

1 Claim, 1 Drawing Sheet

BATHTUB SHOWER SPLASH GUARD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of bathroom accessories, and more particularly to a decorative shower splash shield.

2. Description of Related Art

As can be seen by reference to the following U.S. Pat. Nos. 3,855;642; 3,952,337; 4,189,790; 4,765,001; 4,944,050; and 5,274,859, the prior art is replete with myriad and diverse shower splash guards.

While all of the aforementioned prior art constructions are more than adequate for the basic purpose and function for which they have been specifically designed, they are uniformly deficient with respect to their failure to provide a simple, efficient, and practical modular bathtub shower splash guard.

As a consequence of the foregoing situation, there has existed a longstanding need for a new and improved bathtub shower splash guard and the provision of such a construction is a stated objective of the present invention.

BRIEF SUMMARY OF THE INVENTION

Briefly stated, the present invention provides a bathtub shower accessory comprising a number of shield units, each securable to the tub and shower stall sidewalls in a manner to prevent water from exiting the shower area past the end edges of the shower curtain. The shield units are stackable one on top of the other for the desired height attainment and can include tray compartments on the interior facing side for holding soap, shampoo, toothbrushes, etc., or a towel rack holder.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
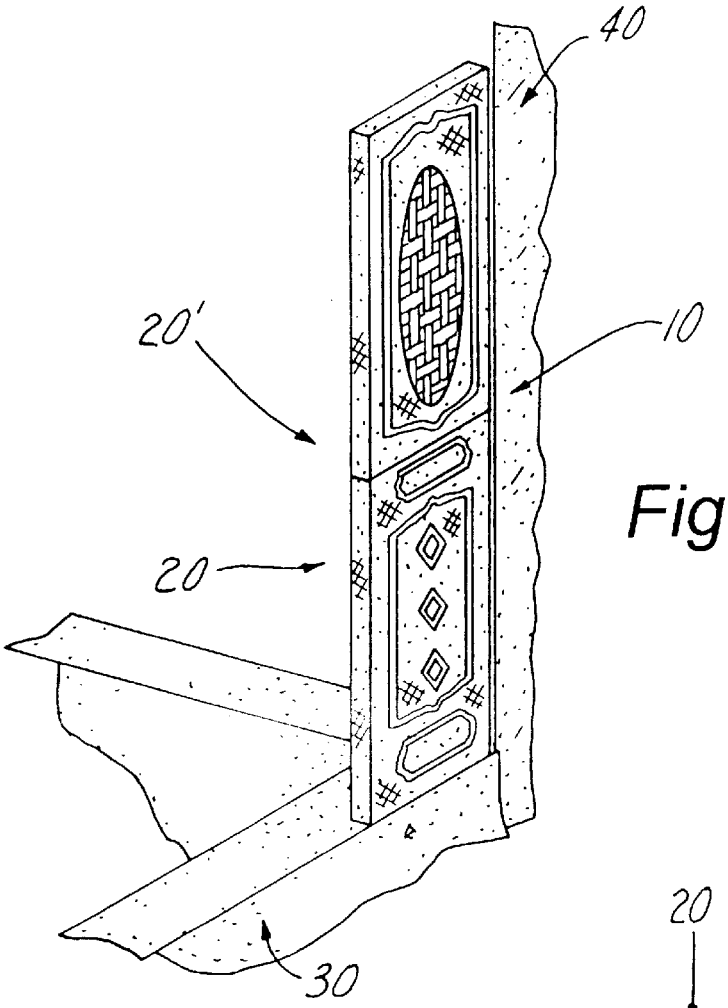
FIG. 1 is a perspective view of the splash guard of the present invention installed on one side of a bathtub shower.
Figure 2:
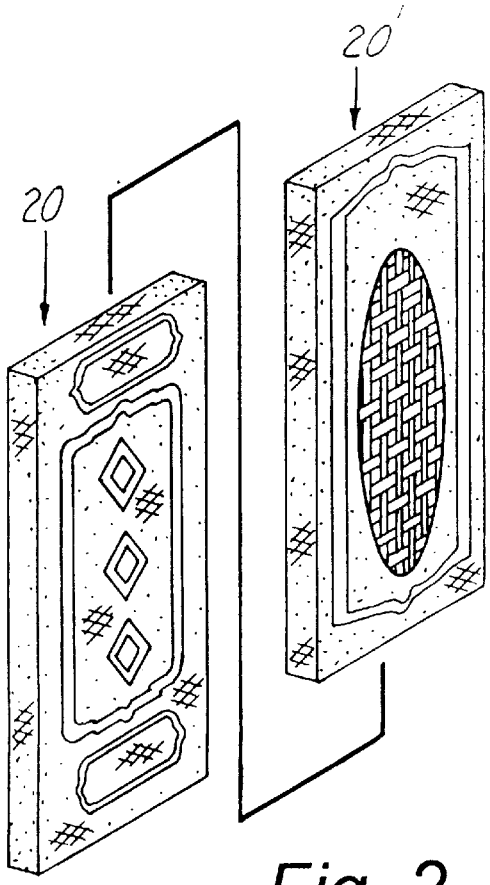
FIG. 2 is an exploded perspective view illustrating the stackable modular panels.
Figure 3:
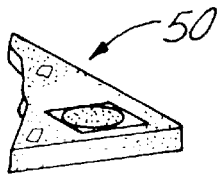
FIG. 3 is a perspective view of the optional shower accessory tray used with the splash guard.

As can be seen by reference to the drawings, and in particularly to FIG. 1, the splash guard that forms the basis of the present invention is designated generally by the reference number 10. The splash guard 10 includes a number of stackable plastic decorative panels 20, 20' approximately nine inches wide that mount at each side of a bathtub shower by means of double sided adhesive tape or silicon adhesive. When installed, they run from the top of the tub edge 30 to the shower curtain rod, along the vertical enclosing walls 40. The panels 20, 20' feature colorful flowers and ornate designs so as to enhance the decor of the bathroom. A matching soap and shampoo tray 50 mount between the panels 20, 20' and the wall 40 allowing soap, shampoo, and toothbrushes to be conveniently stored. The panels 20, 20' come in numerous versions which stack on top of each other.

In use, the user simply mounts the panels 20, 20' at each side of their tub edge 30 along the adjoining walls 40. The optional soap and shampoo tray 50 is installed midway up in the comer of the inside wall 40, if desired. The user enjoys the benefit of having a method of preventing water from getting out of the tub and onto the floor while showering. The colorful decorative panels 20, 20' not only eliminate the need for an exterior shower curtain, but also enhance the decor of the bathroom. Use of the splash guard 10 provides a very practical and easy to use method of preventing water leakage while showering, in addition to adding an attractive new element to the decor of the bathroom.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A splash guard adapted to be used in a bathtub shower including a front ledge defining a horizontal surface and vertical enclosing walls adjacent said front ledge, the splash guard consisting of first and second modular stackable panels formed of a durable plastic and having a decorative surface, the first panel adapted to be attached to the horizontal surface and the adjacent vertical enclosing wall, and the second panel adapted to be attached to a top edge of the first panel and the adjacent vertical enclosing wall; and a shower accessory tray adapted to be attached to one of the first and second panels and the adjacent vertical enclosing wall.

* * * * *